United States Patent [19]

Bolte

[11] Patent Number: 4,872,569

[45] Date of Patent: Oct. 10, 1989

[54] DRINKING VESSELS

[76] Inventor: Brown Bolte, 630 N. Federal Hwy., North Palm Beach, Fla. 33408

[21] Appl. No.: 52,167

[22] Filed: May 12, 1987

Related U.S. Application Data

[63] Continuation of Ser. No. 655,063, Sep. 26, 1984, abandoned, which is a continuation-in-part of Ser. No. 575,546, Jan. 31, 1984, abandoned, which is a continuation-in-part of Ser. No. 470,844, Feb. 28, 1983, abandoned.

[51] Int. Cl.[4] ..... B65D 23/06

[52] U.S. Cl. ..... 215/12.1; 215/100.5; 215/100 R; 220/402; 220/DIG. 5; 220/DIG. 6; 229/1.5 B

[58] Field of Search ..... 215/1 C, 11 E, 12 R, 215/100.5, 100 R, 317, 321; 220/85 H, 402, 403, 404, DIG. 5, DIG. 6; 206/515, 519; 229/1.5 B

[56] References Cited

U.S. PATENT DOCUMENTS

| | | | |
|---|---|---|---|
| 166,350 | 8/1875 | Dodge | 200/85 H |
| 973,085 | 10/1910 | Strause . | |
| 1,035,718 | 8/1912 | Marsters et al. | 220/85 H |
| 2,328,365 | 8/1943 | Tevander | 215/321 |
| 2,782,616 | 2/1957 | Eron . | |
| 2,963,256 | 12/1960 | Borah | 215/100.5 |
| 3,079,027 | 2/1963 | Edwards | 206/519 |
| 3,121,522 | 2/1964 | Ragnow . | |
| 3,138,280 | 6/1964 | Shafer | 220/85 H |
| 3,156,279 | 11/1964 | Grebowiec et al. . | |
| 3,176,868 | 4/1965 | Crisci | 215/321 |
| 3,247,302 | 4/1966 | Lewis . | |
| 3,257,025 | 6/1966 | Jolly | 220/85 H |
| 3,262,626 | 7/1966 | Davis . | |
| 3,279,638 | 10/1966 | Merry | 215/100.5 |
| 3,352,449 | 11/1967 | Jackson . | |
| 3,357,590 | 12/1967 | Safford | 215/100.5 |
| 3,456,860 | 7/1969 | Janninck . | |
| 3,473,682 | 10/1969 | Studen | 215/100.5 |
| 3,484,011 | 12/1969 | Greenhalgh et al. . | |
| 3,550,803 | 12/1970 | Pelli | 220/404 |
| 3,596,795 | 8/1971 | D'Ercoli . | |
| 3,609,263 | 9/1971 | Clementi | 206/519 |
| 3,633,863 | 1/1972 | Abbey . | |
| 3,901,401 | 8/1975 | Lynn et al. | 215/317 |
| 3,971,471 | 7/1976 | Ludder | 206/519 |
| 4,024,951 | 5/1977 | Green | 206/519 |
| 4,040,535 | 8/1977 | Shephard . | |
| 4,098,421 | 7/1978 | Foster | 215/321 |
| 4,231,476 | 11/1980 | Compton et al. | 229/1.5 B |
| 4,261,501 | 4/1981 | Watkins et al. . | |

*Primary Examiner*—David T. Fidei

[57] ABSTRACT

A drinking vessel comprises a first vessel member adapted to hold a liquid and a second vessel member associated with, but separated from, the first vessel member to form a barrier against the formation of condensation on the exterior surface of the second vessel member when a cold liquid is contained in the first vessel member. In one embodiment, the first vessel member comprises a removable insert which conforms generally to the configuration of the second vessel member to form a double-walled drinking vessel. Advantageously, a sanitary lip extends downwardly from the top edge of the insert and is proportioned and oriented to prevent a person's lip from contacting the second vessel member when the person takes a drink. Also advantageously, the drinking vessel includes ribs or serrations, or, preferably, a plurality of protuberances and engagement ridges, ridge segments or recesses associated between the insert and the second vessel member to provide a secure friction fit therebetween yet permit removal of the insert for disposal and subsequent replacement. In another embodiment, the first vessel member comprises a bowl member for holding a liquid and the second vessel member is a hollow stem member supporting the bowl from its base. A collar-like ridge is formed generally at the junction of the stem for collecting any condensation and directing it into the stem. The structure may be formed in two-piece structure or an essentially unitary structure. The structure may, however, include a detachable stem base portion or a stopper-plugged hole in the stem base to facilitate removal of the accumulated moisture.

50 Claims, 4 Drawing Sheets

DRINKING VESSELS

This is a continuation of co-pending application Ser. No. 655,063, filed on Sept. 26, 1984 which, in turn, is a continuation-in-part of my co-pending application Ser. No. 575,546 filed Jan. 31, 1984, now abandoned, which, in turn, is a continuation-in-part of my co-pending application Ser. No. 470,844 filed Feb. 28, 1984, now abandoned.

BACKGROUND OF THE INVENTION

The present invention relates generally to drinking vessels, and, more particularly, to drinking vessels which provide an exterior surface portion that is virtually free of condensation and to reusable/disposable drinking vessels which provide a sanitary surface for drinking.

There have been many proposals for making various types of drinking containers or vessels, each adapted to satisfy a particular need. For example, there are containers which incorporate disposable liners, such as disclosed in U.S. Pat. No. 3,352,449, to permit re-use of a permanent container. In other devices, such as disclosed in U.S. Pat. No. 973,085, or 3,633,863, or 4,040,535, a coaster or holder arrangement is provided for snugly holding a tumbler and collecting, within the coaster, condensation forming on the tumbler.

Although such structures may prove satisfactory for their particular intended purpose, they fail to provide a drinking vessel with a sanitary disposable insert which conforms to the configuration of a permanent vessel member and provides a thermally insulative barrier as well as a condensation barrier, all in a simple-to-fabricate structure. Furthermore, there is no teaching of a condensation-free stemware piece.

It would appear desirable, therefore, to provide a drinking vessel with disposable inserts which provides a thermally insulative barrier to help maintain the temperature of substances contained therein, to prolong the life of ice cubes when contained therein and, further, to shield the user from any dripping due to condensation forming on the vessel.

More importantly, as there is currently great concern for the transmission of various bacteria and infectious viruses and germs (particularly herpes simplex which can be readily transmitted through improperly sterilized drinking containers at restaurants, bars and other publically accessible establishments), there is a growing need for an attractive drinking vessel which can be used repeatedly yet assure germ-free drinking surfaces. Thorough sterilization requires expensive and well maintained machinery, as well as the time and effort of employees in collecting used glasses, stacking them for sterilization, operating the machinery and removing them after sterilization. It is, therefore, desirable to provide not only a condensation-free disposable drinking vessel but also one which provides protection against the transmission of infectious germs, viruses, bacteria and the like, all in an attractive and easy to make structure.

Accordingly, it is an object of the present invention to provide a new and improved drinking vessel having exterior surface portions essentially free of condensation.

It is another object of the invention to provide a new and improved drinking vessel having condensation-free exterior surface portions and a thermally insulative barrier for helping diminish heat loss or gain in any substance contained by the vessel. In addition, it is an object of the invention to provide a re-usable drinking vessel of the foregoing type that permits re-use of a permanent drinking vessel member without requiring sterilization of the permanent member. It is a further object of the invention to provide a drinking vessel of the foregoing type which is easy to fabricate and yet forms an attractive drinking container.

It is also an object of the invention to provide a new and improved stemware structure which provides an essentially condensation-free exterior surface for handling, yet permits an elegant design to be incorporated in the stemware. It is another object of the invention to provide, in whole or in part, a disposable stemware structure which has an essentially condensation-free surface.

The foregoing specific objects and advantages of the invention are illustrative of those which can be achieved by the present invention and are not intended to exhaust the possible advantages which can be attained. Thus, these and other objects and advantages of the invention can be learned by practice with the invention as embodied herein or as modified in view of variations which will be apparent to those skilled in the art from the disclosed embodiments. Accordingly, the present invention resides in the novel parts, constructions, arrangements, combinations and improvements herein shown and described.

SUMMARY OF THE INVENTION

Briefly described, the drinking vessel according to the present invention comprises a first vessel member adapted to hold a liquid or other desired substance and a second vessel member associated with, but separated from the first vessel member to form a barrier against the formation of condensation on an exterior surface of the second vessel member when a cold liquid or substance is contained in the first vessel member. In one embodiment, the first vessel member comprises a removable insert which conforms generally to the configuration of the second vessel member to form a double-walled drinking vessel with a space between the insert and the second vessel member. Advantageously, a sanitary lip extends downwardly from the top edge of the insert and is proportioned and oriented to prevent a person's lip from contacting the second vessel member when the person takes a drink. Also advantageously, the drinking vessel includes grasping means (in the form of a plurality of rib-like members or a band of serrations, or, as preferably embodied, a plurality of protuberances and cooperating engagement means) associated between the insert and the second vessel member to provide a secure pressure/friction fit therebetween yet permit removal of the insert for disposal and subsequent replacement by thrusting the second vessel member, open-side down, onto a stack of inverted inserts.

As perferably embodied, the grasping means include a plurality of protuberances formed on one of the vessel members, and engagment means formed on the other vessel member for cooperating with the protuberances to enable releasable locking engagement between the two vessel members. The engagement means may comprise a ring-like raised rib or ridge against which the protuberances can abut to resist separation of the two members or a ring-like recess adapted to register with and receive the protuberances. Alternatively, the engagement means may comprise a series of screw thread segments (in the form of either raised ridge segments or recess segments) adapted to permit threaded engagement by the protuberances when one vessel member member is turned or screwed down relative to the other. In any of the foregoing embodiments of grasping means, the protuberances are preferably formed on the replaceable insert member (preferably on the interior surface of the lip) for ease of mass fabrication and the engagement means are formed on the permanent vessel member (preferably on its exterior surface).

Advantageously and as preferably embodied, each insert includes a reduced-diameter lower portion, formed by a steplike indentation which provides an interior ledge or shoulder to abut the bottom of another insert when stacked adjacent each other and prevent them from sticking together. Also as preferably embodied, the second vessel member is formed with vent means for preventing any pressure increase or decrease (due to contraction or expansion of the insert when subjected to cold or hot liquids) by permitting air to enter or exit the thermal space between the insert and second vessel. To facilitate molding in a two-part mold, the vent is formed in the bottom of the second vessel member, and the second vessel bottom is preferably raised slightly to ensure that the vent is not blocked—e.g., by forming a concave bottom or by extending the side walls of the vessel (in which case the vent should have a small tubular wall or ridge to prevent the passage therethrough of any condensation accumulated in the bottom of the second vessel).

In another embodiment, the invention may be adapted to provide a condensation-free stemware structure. The stemware structure comprises a bowl member for holding a liquid and a hollow stem member supporting the bowl from its base. A collar-like ridge is formed generally at or near the junction of the stem and bowl members and is in communication with the hollow stem for collecting any condensation traveling downwardly from the bowl member and directing it into the stem. The stemware structure may be formed in a two piece structure wherein the bowl member includes a stem portion adapted to fit into an opening at the top of the stem member which thereby forms the collar-like ridge. Alternatively, the stemware structure may be an essentially unitary structure with openings in the wall of the hollow stem adjacent the collar-like ridge which provides a ring-like trough that acts like a catch basin to collect condensation flowing down the bowl member and permit it to flow from the collar trough into the interior of the stem member. The unitary stemware may include a detachable stem base portion or a stopper-plugged hole in the stem base to facilitate removal of accumulated moisture.

It will be apparent from the foregoing general description, as well as the following detailed description, that the objects and advantages specifically enumerated herein are achieved by the present invention. For example, by providing an insert conforming to the configuration of a permanent vessel member, an interior space is provided which acts both as a thermal insulating barrier to liquid contained in the insert and as a shield against the formation of condensation on the exterior surface of the permanent vessel member. In addition, by providing the lip on such inserts, a shield is automatically formed to prevent the transmission of germs, bacteria, etc. from one user to the next when the insert is replaced, yet permit re-use of the permanent vessel member in a perfectly sanitary condition without requiring sterilization or washing.

By fabricating the insert so as to be disposable, the permanent vessel member can be re-used repeatedly without requiring any sterilization, yet the combination provides a sterile drinking vessel for different users of the permanent vessel. In addition, the grasping means associated between the insert and permanent vessel facilitates convenient storage of a stack of inserts while permitting the permanent member to be quickly and easily combined with a fresh insert. Moreover, the insert can be adapted to conform to the shape of virtually any drinking vessel, e.g., a tumbler, a stemware piece, etc.

It will also be understood that by forming a series of protuberances on one vessel member and engagement means in the form of either a raised ridge structure or a recess or indentation arrangement (whether in continuous ring-like fashion or as a series of segments adapted to threadably engage the protuberances), a secure locking engagement will be achieved between the two vessel members while release of the members can be effected with relative ease. In addition, forming the protuberances on the disposable insert member, preferably on the interior surface of the lip formed will facilitate mass production by conventional two-part molding techniques and permit the inserts to be conveniently stacked on top of each other, yet will space the stacked inserts from each other to keep adjacent ones from sticking together when one is removed from the stack.

By forming a step-like discontinuity near the bottom of the insert with the interior diameter at the step being smaller than the outer diameter of the insert bottom, a plurality of inserts can be inverted and stacked on top of each other with the reduced-diameter step providing a ledge or shoulder to abut the bottom of the insert below it so that when the second vessel is thrust against the stack, only one insert is lifted off the stack, without any of the other inserts in the stack becoming wedged together.

In addition, by providing vent means in the second vessel member (preferably so as to be spaced from the table top or like supporting surface), air is free to exit or enter the interior thermal space to relieve any build-up or decrease of pressure therein and thereby prevent cracking of the insert due to expansion or contraction when subjected to hot or cold substances. Also, by providing a raised interior rim or ridge on the vent, any condensation collected within the second vessel member will not leak out.

By providing a stemware structure with a hollow stem and a collar-like ridge in communication with the hollow stem, any condensation forming on the exterior of the bowl will flow into the hollow stem to provide a dry surface on the exterior of the stem for holding the stemware. In addition, the stemware structure according to the invention can be formed as a totally permanent, a partially disposable or a totally disposable drinking vessel.

It will be appreciated by those skilled in the art that the foregoing general description and the following detailed description are exemplary and explanatory of the invention but are not intended to be restrictive thereof. Thus, the accompaying drawings, referred to herein and constituting a part hereof, illustrate preferred embodiments of the invention, and, together with the detailed description, serve to explain the principles of the invention.

DETAILED DESCRIPTION OF PREFERRED EMBODIMENTS

Turning now to the embodiments of the invention illustrated in the accompanying drawings, there is shown in FIGS. 1–12 various features according to one basic embodiment of the present invention.

Figure 1:
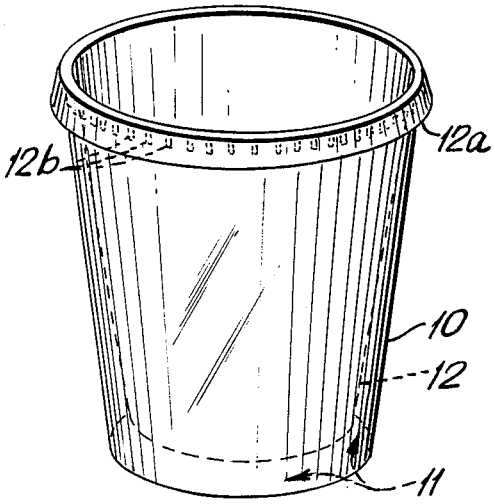
FIG. 1 is a front isometric view of one embodiment of a drinking vessel according to the present invention.
Figure 2:
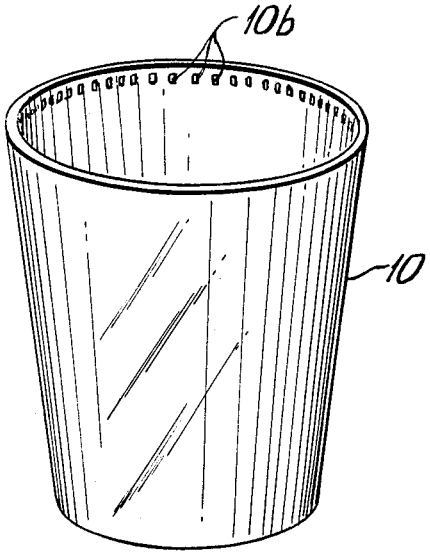
FIG. 2 is a front isometric view of the outer, or permanent, vessel member of the embodiment of FIG. 1.
Figure 3:
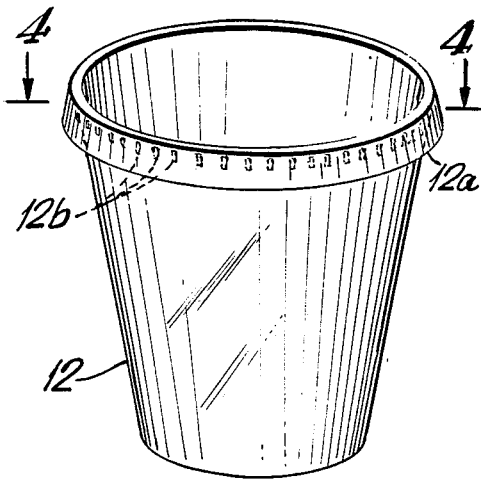
FIG. 3 is a front isometric view of the inner vessel member, or insert, of the embodiment of FIG. 1.
Figure 4:
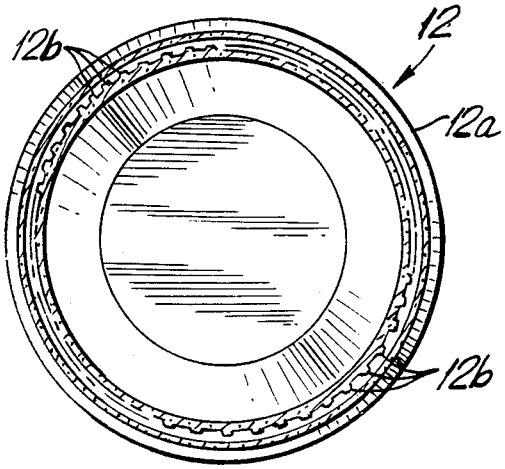
FIG. 4 is a sectional view taken along lines 4—4 of FIG. 3.
Figure 5:
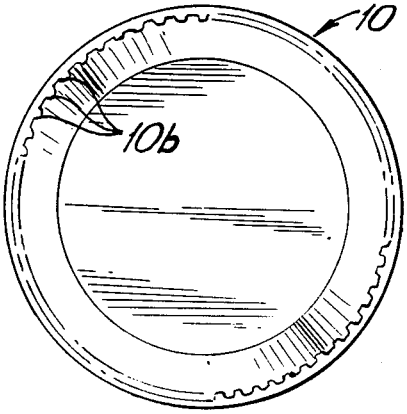
FIG. 5 is a sectional view, similar to FIG. 4, of only the outer vessel member, showing a slightly modified embodiment.
Figure 6:
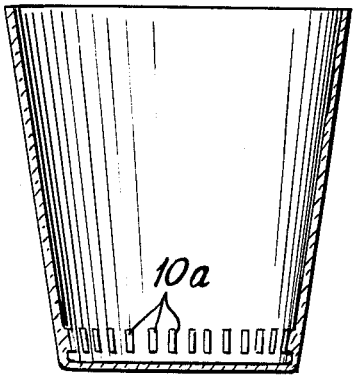
FIG. 6 is a front elevation view of the outer vessel member in the embodiment of FIG. 1 showing still another modified embodiment.

Referring more particularly to FIGS. 1, 3 and 4, there is shown an embodiment of a drinking vessel according to the present invention which comprises an outer, or permanent, vessel member 10 which can be a tumbler-like vessel made of a permanent material such as, e.g., glass. Insert member 12 is proportioned to be received within outer vessel member 10 for receiving and containing any desired liquid or other substance. As preferably embodied, insert 12 is proportioned to conform generally to the configuration of the outer vessel, yet provide a spacing (indicated generally at 11) between the adjacent sidewalls and bottom walls of the outer vessel and the insert. The spacing 11 serves as a thermally insulative buffer to help reduce the thermal effect of the ambient atmosphere on the contents of insert 12. Advantageously, then, insert member 12 is proportioned to taper slightly in a direction from its top to its bottom relative to the sidewalls of permanent vessel 10 so as to make essentially only line contact with vessel 10 at its top opening.

Also advantageously, insert 12 includes an exterior lip 12*a* depending from the entire top open edge, or upper rim, of the insert and extending downwardly towards the bottom of the insert. As preferably embodied, lip 12*a* is proportioned and angled relative to the exterior sidewall of permanent vessel 10 so as to substantially prevent a person's lip from contacting any exterior surface of vessel 10 when the person drinks from the insert. To this end, the width of lip 12*a* (i.e., the distance between the upper rim of the insert and the distal free end edge of the lip) may be from about $\frac{3}{8}''$ to about $\frac{1}{2}''$ (or even up to about $\frac{3}{4}''$) and may form an angle of up to about 35° with respect to the sidewalls of insert 12 to form an angle of up to about 30° with respect to the sidewall of vessel portion 10. In a particularly useful embodiment, insert lip 12*a* can be about $\frac{1}{2}''$ wide and extend at an angle of from about 3.5° to about 5° relative to the exterior wall of the second vessel member.

It will thus be understood by those skilled in the art that the width of lip 12*a* and the angle it forms with respect to the sidewall of vessel 10 cooperate to keep a person's lip spaced from the vessel sidewalls so as to prevent physical contact therewith. As a result, by adapting insert 12 so as to be disposable, the combination of insert 12 with permanent vessel 10 permits repeated re-use of the permanent vessel 10 without requiring sterilization, simply by replacing the used insert with a fresh one. Since the user's lips do not touch vessel 10, the passage of orally transmissive germs, bacteria and virus (e.g., herpes simplex) is effectively prevented, and the time, effort and cost of washing vessel 10 after every use is avoided.

In order to hold insert 12 sufficiently securely to vessel 10 while retaining a liquid therein, means are provided for forming a pressure-fit, or friction-fit, between insert 12 and vessel 10. As shown in FIGS. 3 and 4, the pressure-fit means comprise raised ribs 12*b* formed on the exterior surface of insert 12, for providing a pressure/friction fit with the corresponding interior surface portions of vessel 10. Advantageously, ribs 12*b* are located substantially at or near the top of insert 12 (i.e., at about the widest part of the insert) for maximizing the pressure-fit generated between the insert and vessel 10. Also, by locating the ribs 12*b* adjacent the top edge of insert 12, a plurality of such inserts can be conveniently stacked one-on-another for minimizing the space they occupy while ensuring that adjacent inserts in the stack will not tend to stick together when the top insert is being removed.

Alternatively (or concurrently), raised ribs (show at 10*b* in FIGS. 2 and 5) could be formed on the interior surface of vessel 10, substantially near or at its top edge so as to form a pressure/friction fit between the ribs 10*b* and a corresponding exterior surface of insert 12 (either against a smooth surface or in cooperation with ribs 12*b*). In still a further modification, ribs (not shown) could be formed on the interior-facing surface of lip 12*a* (alone or in combination with ribs 12*b* and/or 10*b* described above), substantially at the top edge of the insert, so as to form a pressure/friction fit with the corresponding exterior surface of vessel 10 at its top edge. It will be appreciated that by forming pressure/friction fit ribs as disclosed herein, a vessel 10 can be thrust, open top facing downwardly, onto a stack of inverted inserts and thence raised, taking only one fresh insert from the stack to hold any desired liquids or other substance and then be removed for disposal after use.

In still a further modified embodiment of the invention, pressure/friction fit ribs, or radially inwardly extending fins (indicated at 10*a* in FIG. 6) can be formed on the interior surface of vessel 10, near its bottom, to contact the corresponding exterior surface at the bottom of insert 12. Since insert 12 is preferably more tapered than vessel 10, ribs 10*a* should project sufficiently far into the interior of vessel 10 to grasp the insert. Alternatively, although not shown, pressure/friction fit fins could be formed on, and project radially outwardly from the exterior surface of insert 12 near its bottom. Thus, as the insert is lowered into the permanent vessel 10 (preferably being tapered), the fins will engage the interior wall surface of vessel 10 until a secure pressure fit is formed.

It will be readily appreciated by those skilled in the art that the double-walled drinking vessel according to the present invention, as disclosed by the foregoing description with reference to FIGS. 1–6, provides a thermally insulated container wherein, e.g., a cold liquid or liquid-and-ice combination contained within insert 12 will experience prolonged temperature maintenance (for increased ice cube life) due to the thermal air barrier between insert 12 and permanent vessel 10. In addition, because the exterior surface of vessel 10 is physically separated and insulated from liquid-containing insert 12, any condensation resulting from a cold liquid in insert 12 will form on the exterior surface of the insert, not vessel 10, for ultimate collection within the interior of vessel 10, thereby eliminating the spotting and annoyance due to moisture dripping from the drinking vessel.

It will further be appreciated that the orientation and configuration of the insert lip permits re-use of a permanent drinking vessel without requiring sterilization. After use, the disposable insert is simply removed and thrown out. The permanent vessel can merely be wiped dry and then thrust down onto a stack of replacement inserts, whereupon, as indicated above, only one insert is grasped by the permanent vessel to instantly provide a clean and sanitary drinking vessel.

It will be understood that since insert 12 is preferably adapted to be disposable, it can be made of any known inexpensive plastic, such as, e.g., a material sold by E. I. duPont under the trademark designation "LUCITE" or similar material. The insert is preferably made of a transparent material to help create the impression that the insert/vessel combination is a traditional all-glass structure. In addition, raised ribs 10*b* or 12*b* could take the form of a band relatively small serrations on insert 12 and/or permanent member 10. It may, however, be preferable to form such serrated band on the interior surface of vessel 10 for grasping a smooth surface on the inserts for greater ease in fabricating inserts in large quantities and further ensuring that only one insert is removed from a stack at a time.

Figure 7A:
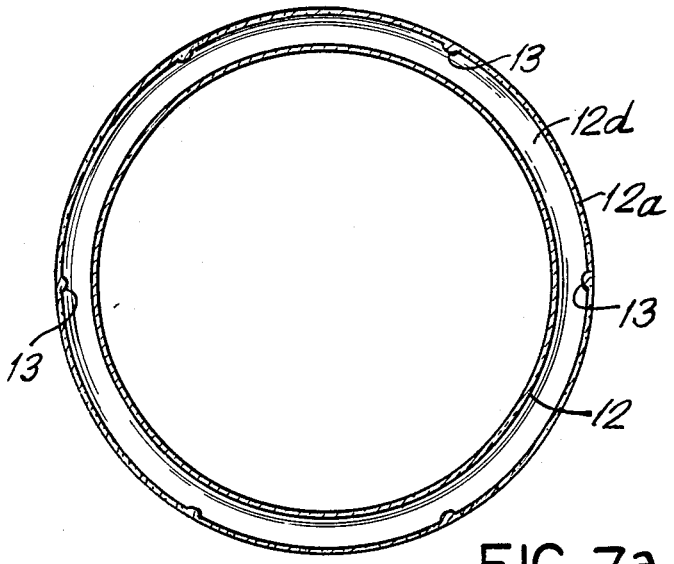
FIG. 7A is a sectional view taken along lines 7A—7A of FIG. 7.
Figure 7:
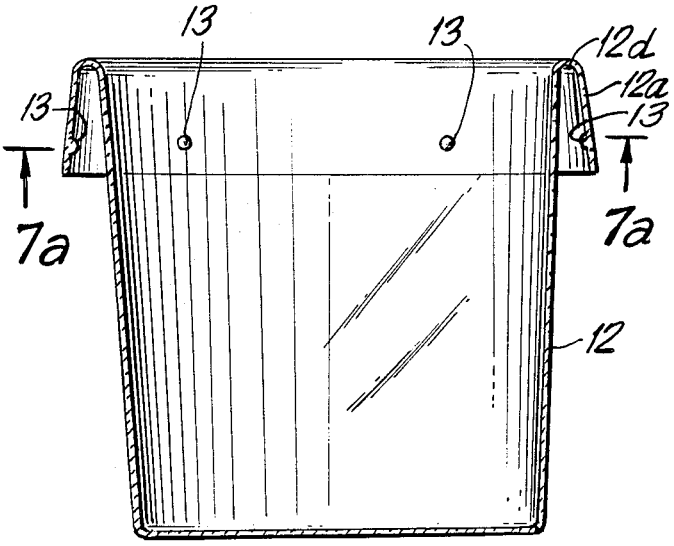
FIG. 7 is a sectional view, taken generally through the middle, of an insert member according to another preferred embodiment of the invention.
Figure 9:
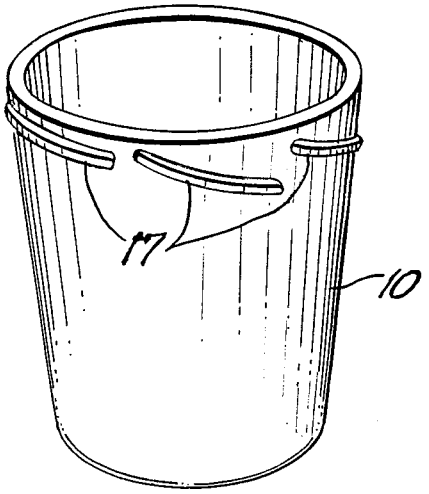
FIG. 9 is an isometric view of still another modified version of the permanent vessel member.

Turning now to FIGS. 7–9, there are shown various embodiments of the insert and vessel combination incorporating preferred grasping means according to the invention for releasably locking insert 12 to vessel member 10. As here preferably embodied, the grasping means comprise a series of protuberances (each designated 13) formed on the inwardly facing surface of lip 12*a*, with engagement means (described hereinafter) formed on the second vessel member for permitting releasable locking engagement therebetween for retaining the insert member within the permanent vessel member. Advantageously, protuberances 13 are generally hemispherical and substantially solid or otherwise formed so that the opposite exterior surface of lip 12*a* is essentially smooth. In this way, not only will the insert lip have an attractive exterior appearance, but also the protuberances will serve to space the adjacent inserts slightly from each other when stacked on top of each other for ensuring that the top-most insert will not stick to the next one when the permanent vessel member is thrust downwardly onto an inverted stack of inserts.

According to one preferred embodiment, the engagement means on vessel member 10 comprises a ring-like rib, or ridge, (indicated at 15 in FIG. 8*a*)projecting outwardly from, and extending completely around, the exterior surface of vessel 10. Ridge 15 is proportioned and located so as to allow the protuberances 13 to ride over its crest (or apex) to bear against the lower surface portion of the ridge and thereby releasably lock the insert within the permanent vessel. However, because of the resilience of the lip, the insert can be disengaged from the vessel simply by exerting a sufficient pulling force to cause the protuberances to ride back over the crest of ridge 15.

A particularly useful embodiment of the vessel/insert combination utilizes the preferred grasping means of the invention with a tumbler-type drinking receptacle. In this embodiment, permanent vessel 10 may be about $3\frac{1}{2}''$ tall and about $3\frac{1}{4}''$ in circumference, and the insert is proportioned to fit within the permanent vessel, allowing a space (11) of from about $\frac{1}{8}''$ to about $\frac{1}{4}''$ between the two vessel members. Ring-like ridge 15 is formed on the exterior surface of vessel 10, at a point approximately 0.3" from the upper rim of vessel 10. The cross-sectional configuration of ridge 15 is generally bead-like, or semi-circular, having a radius of about 0.032". (the hemispherical protuberances 13 similarly have a radius of about 0.032".) Advantageously, the upper portion (indicated at 10*a*) of vessel 10 has a slight outward flare between its upper lip and the ridge 15 in order to accomodate the flare of insert lip 12*a*. It will be understood that the provision of such flare on vessel 10 will also provide a so-called "negative draft" to facilitate formation of ridge 15 on vessel 10 by conventional two-part molding techniques.

Figure 12:
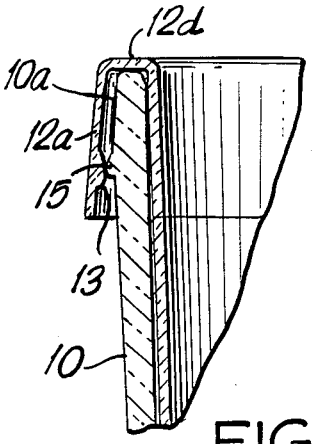
FIG. 12 is a partial sectional view taken through an assembled insert and permanent member according to the invention.

The side wall of insert 12 may be at angle of about 3.5° to about 4° (preferably about 3.7°) relative to the vertical, and lip 12*a* flares outwardly at an angle of about 4.5° to about 5° (preferably about 4.7°) relative to the vertical. The lip is about $\frac{1}{2}''$ wide and the distal free end edge of the lip 12*a* is preferably rounded to prevent any possibility of cutting a user. The distance between protuberances 13 and the interior surface of the arched segment (designated 12*d*) which joins lip 12*a* to the insert sidewalls, and thus forms the upper rim of insert 12, is also approximately 0.3" but preferably slightly larger than the corresponding dimension on vessel 10 to ensure that, once the insert is fully seated in the vessel, the protuberances will abut the underside of ridge 15 to keep the insert captive in the vessel. Advantageously, the lip and protuberances may be proportioned so that the protuberances will bear against the lower surface portion of ridge 15, just below the apex, to urge lip 12*a* slightly outwardly and thereby generate a slightly greater flare for spacing a user's lip farther from the exterior surface of vessel 10, as illustrated in FIG. 12.

Referring now to FIG. 9, there is shown an alternate embodiment of engagement means on vessel 10 for cooperating with protuberances 13 formed on insert 12. Instead of a continuous ring-like ridge 15 around vessel 10, a series of ridge segments (each designated 17) can be formed at generally the same upper exterior surface portion of vessel 10. It will be understood that there should be the same number of ridge segments as there are protuberances on insert 12.

Advantagously, each ridge segment is at a slight angle relative to the upper rim of vessel 10 for permitting threadable engagement with the protuberances. To facilitate proper threaded engagement, the uppermost end of each ridge segment should be closer to the upper rim of vessel 10 than the corresponding distance between the protuberances and the arched portion 12*d* of the insert, while the lowermost end of each ridge segment is spaced a slightly greater distance from the upper rim of vessel 10 than such corresponding distance. As a result, threadable engagement between the protuberances and the ridge segments is ensured, and there need not be any overlap (along the vertical direction) between any portions of adjacent ridge segments, thereby permitting fabrication of vessel 10 by conventional two-part molding techniques.

In operation of the latter embodiment of engagement means, the insert is placed within vessel 10 and turned until each protuberance abuts the underside of a ridge segment. The insert will thus be locked in place within the permanent vessel, ready for use. By tightening the insert slightly, the protuberances will ride up along the underside of the ridge segments thereby increasing the flare of insert lip 12*a* slightly, in essentially the same way as explained above. After use, the insert is unthreaded by turning it in the opposite direction and simply lifted out of the vessel after the protuberances are clear of the ridge segments.

It will be understood by those skilled in the art that, instead of the ring-like ridge or ridge segments described above, the engagement means formed on vessel 10 for lockably engaging the protuberances could be in the form of indentations, or recesses, positioned and proportioned to register with and receive the protuberances. In addition, the protuberances could be formed on other portions of the insert, with the engagement means formed on a corresponding portion of the permanent vessel. If desired and mass fabrication techniques warrant, the protuberances could be formed on permanent vessel 10 and the engagement means formed on the inserts. However, for economy and ease of fabrication and for the advantages set forth above, it is preferred that the protuberances be formed on the inserts.

Referring now more particularly to FIGS. 8*b*, 8*c* and 10–11*a*, there are illustrated certain further preferred aspects of the present invention.

Figure 8B:
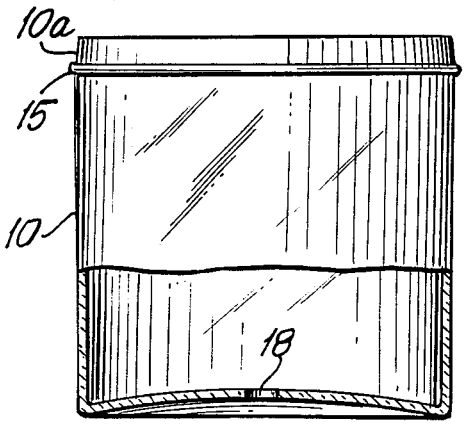
FIG. 8*b* is an elevation view, with partial cut-away, of a modified version of the permanent vessel illustrated in FIG. 8*a*.
Figure 8C:
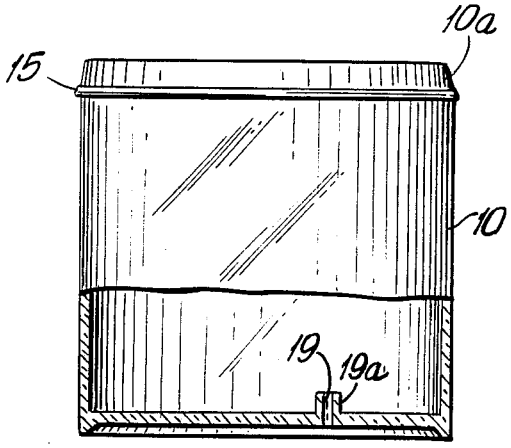
FIG. 8*c* is an elevation view, with partial cut-away, of another modified version of the permanent vessel illustrated in FIG. 8*a*.

FIGS. 8*b* and 8*c* illustrate two versions of permanent vessel 10 which are adapted to incorporate vent means for relieving pressure in the internal thermal space 11. As illustrated in FIG. 8*b*, the bottom of the permanent vessel is generally concave and vent means, in the form of opening 17, is formed at the apex of the concave bottom. Opening 17 permits air to leave or enter internal thermal space 11 due to any expansion or contraction of insert 12 caused by the presence of any hot or cold substances in insert 12. The vent prevents either an increase or a decrease (i.e., a vacuum-like condition) of pressure within thermal space 11 caused by relatively large temperature differences which might otherwise contribute to cracking of the insert. (It should be understood that when insert 12 is fully seated within permanent vessel 10, a fairly fluid-tight seal can be formed along their upper edges.)

Because opening 17 is formed at the apex of the concave bottom, any condensation accumulated within the permanent vessel 10 will collect at the lower-most corners of the vessel, away from the opening. Even as the combined vessel structure is tilted during use, none of the accumulated condensation will drip out of opening 17 because of its raised upper rim.

FIG. 8*c* shows a modified embodiment of the vented permanent vessel 10 wherein an opening (here indicated at 19) is formed in a flat bottom of vessel 10. The vent here also includes an upwardly projecting wall 19*a* which surrounds opening 19 and serves to prevent any accumulated condensation from dripping through the opening 19, whether the vessel is resting on a horizontal surface or being tilted by a person to take a drink. Advantageously, the bottom of the insert includes spacer means to raise its bottom surface from a table top or like support surface. Here, the sidewalls of vessel 10 project slightly beyond the bottom surface of the vessel bottom to space the bottom surface from any support surface and ensure that the opening 19 is not blocked and to ensure that no condensation "ring" is formed on the table top. (It will also be understood that other convenient spacing means could be used, such as protuberances formed on the bottom surface of the vessel bottom.) The opening 19 and wall 19*a* may be offset from the center of the vessel bottom to facilitate molding in a two-part mold.

Figure 10:
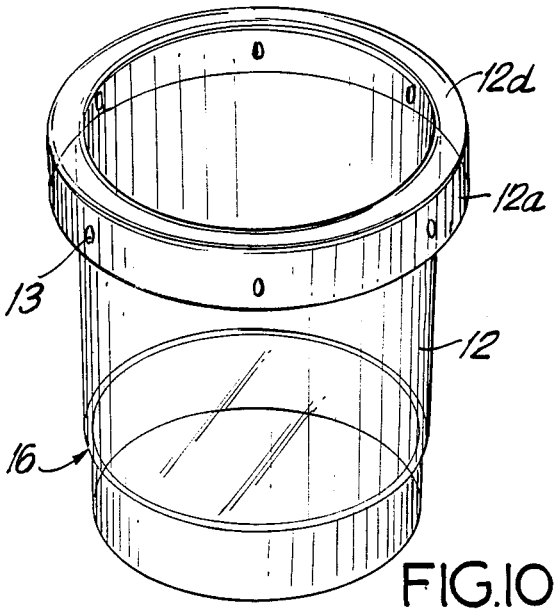
FIG. 10 is an isometric view of a preferred embodiment of insert member according to the present invention.
Figure 11A:
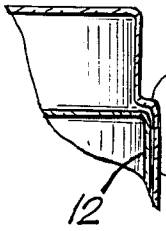
FIG. 11*a* is a partial sectional view of two abutting inserts in the stack of FIG. 11.
Figure 11:
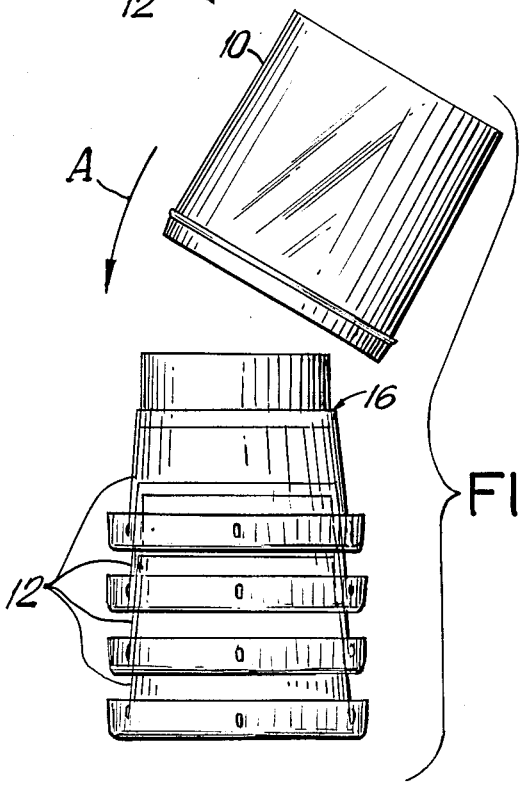
FIG. 11 is an elevation view of a stack of inserts according to the present invention, showing assembly of the insert and permanent vessel.

FIGS. 10–11*a* illustrate a preferred embodiment of insert 12 which is adapted to ensure no-stick stackability. To this end, insert 12 (which is otherwise essentially the same as described above) is formed with step-like discontinuity 16 near its bottom to form a stacking ledge on the interior surface of the insert. Advantageously, the interior diameter of the insert at (or just slightly below) the step 16 is at least slightly less than the exterior diameter of the bottom of the insert. It will thus be understood that the step 16 provides a stacking ledge or shoulder for abutting the bottom of another insert to prevent further insertion of that insert beyond the ledge, and thereby be supported by the ledge in a stack, as illustrated by FIG. 11*a*.

It will be understood that the taper of insert 12 can be greater above step 16 than below it. In fact, the taper of the lower portion can be at the minimum draft angle needed to remove the insert from the mold and thereby maximize the outer diameter of the insert bottom.

FIG. 11 shows how a plurality of inserts 12 of the type illustrated in FIG. 10 can be stacked for easy assembly with permanent vessel 10. The inserts are stacked in an inverted orientation, one on top of another with the bottom of one abutting the ledge formed on the insert above it. The permanent vessel 10 is thrust, open end down, onto the stack of inserts, as indicated by arrow A in FIG. 11. Once the open end 10*a* of the permanent vessel is fully seated within the annular slot formed by flange 12*a* on insert 12 (as illustrated by FIG. 12), the permanent vessel 10 can simply be lifted back up with an insert secured thereto. Since the bottom of the next insert abuts the ledge formed by step 16, only the top insert is removed, and none of the other inserts become wedged together, leaving all of them free to be removed one at a time. Advantageously, therefore, the distance between the step 16 and the insert bottom is generally about equal to or greater than the height of insert flange 12*a* to ensure that two adjacent inserts cannot become wedged together. (Of course, it can be somewhat less than the lip height so long as the wedging effect is prevented.)

It will also be understood that the reduced diameter portion at the bottom of each insert will facilitate removal of an insert after it has been used. Because of the relatively secure attachment of the insert to the permanent vessel, the easiest way to remove an insert is simply to push upwardly against the insert lip 12*a* at one point, thereby causing an angular displacement between the insert and the permanent vessel. The reduced diameter at the bottom of the insert will facilitate such angular displacement.

In an exemplary embodiment, the insert is about 3 inches tall and about 3 inches in diameter at its upper rim. The lip 12*a* is about ½ inch in height and the step 16 is formed about 11/16 of an inch from the bottom. The insert is made of a crystal styrene plastic material (and can range in thickness from about 0.011" to about 0.030"). With the vented permanent vessel of the type disclosed above, (which can be made of an S.A.N. plastic), this insert can withstand hot liquids up to 190° F. (the maximum temperature at which most hot beverages are served) without cracking.

Figure 13:
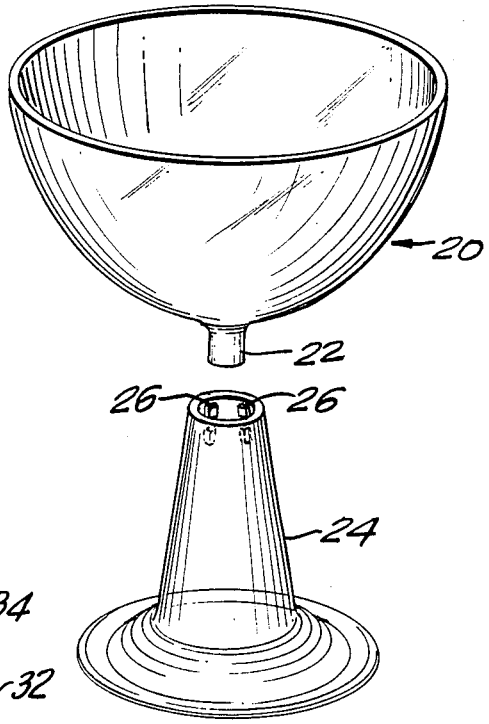
FIG. 13 is a front isometric view of an embodiment of a stemware structure according to the present invention.

Turning now to FIG. 13 there is shown a two-piece embodiment of a stemware structure adapted to provide a condensation-free exterior surface in accordance with the present invention. As here embodied, the stemware structure comprises bowl member 20 which may be in any desired configuration just like traditional glass stemware (e.g., as a champagne-style glass, a wine-style glass, continental-style glass, etc.) and a stem member 24 adapted to support the bowl member. Advantageously, stem 24 is generally hollow and is adapted to be attached to bowl 20 by releasably engaging bowl stem portion 22 (formed on the bottom of 20) when inserted into the open top of the stem. Advantageously, a gap is formed between stem 24 and stem portion 22 when coupled together to allow any condensation forming on the bowl to drop into the hollow stem. To this end, the interior surface of stem 24 near its open upper end is provided with rib members 26 (much like the ribs described above with reference to FIGS. 1-6) which are proportioned to form a pressure/friction fit with stem portion 22 of bowl 20, yet leave gaps between the upper interior wall of stem 24 and the exterior of stem portion 22.

In use, bowl member 20 is attached to stem 24 by inserting bowl stem portion 22 into the opening of hollow stem 24 until a snug pressure fit is formed between stem portion 22 and ribs 26. (To this end, stem portion 22 may taper slightly from its juncture with bowl 20 to its bottom and the radially interior surfaces of ribs 26 may be either substantially vertical or inclined so that the rib bottoms project inwardly a little more than the rib tops to ensure a snug fit at some point during insertion.) When a cold liquid or other substance is placed in bowl 20, any condensation forming on the bowl will roll down its sides and onto stem portion 22 from which it drips harmlessly into the hollow chamber within stem 24.

Figure 13A:
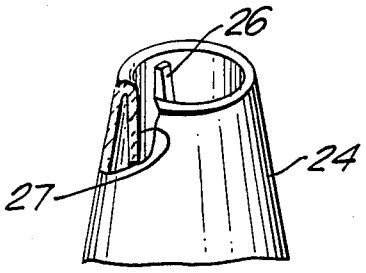
FIG. 13*a* is a partial front isometric view with partial cut-away section, of a modified version of the embodiment of FIG. 13.

Advantageously, and as preferably embodied, the walls of stem 24 diverge from each other (from top-to-bottom) so that as a person tips the stemware to drink from bowl 20, condensation colelcted within stem 24 will not spill out. As illustrated in FIG. 13*a*, stem 24 could also include an interior cylindrical lip 27 depending from the open top of stem 24 to help further prevent the chance of moisture spilling out while the stemware is tipped. Ribs 26 could, therefore, be formed on the interior of cylindrical lip 27 or on stem portion 22. In either event, the top edges of ribs 26 are preferably located below the top edge of stem 24 to ensure that downwardly flowing moisture cannot flow over the edge and onto the exterior surface of stem 24.

After one or more fillings, bowl 20 can be detached from stem 24 and the condensation therein spilled out. It will be understood, then, that stem 24 can be made of glass or otherwise adapted to be permanent (like vessel 10 described above), while bowl 20 can either be disposable or permanent. (A disposable bowl 20 will obviate the need for sterilization, etc., like insert 12.) It will further be understood that because stem 24 is separated from bowl 20, the exterior surface of stem 24 will be virtually free of condensation to provide a dry surface portion for holding the stemware.

Figure 14:
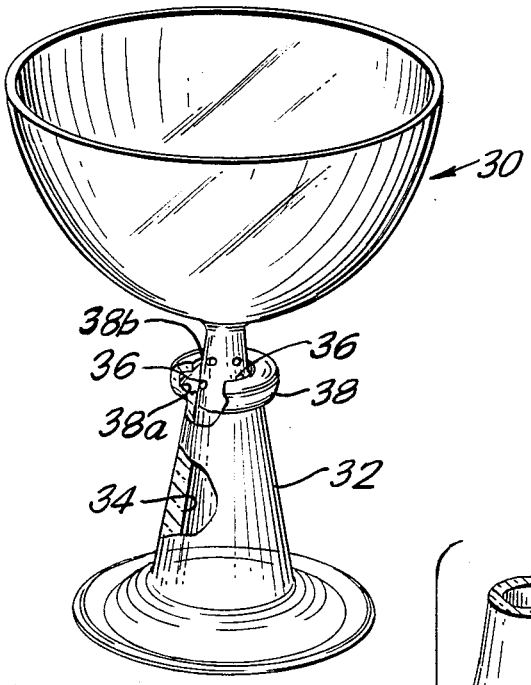
FIG. 14 is a front isometric view of a modified embodiment of stemware according to the present invention.

Turning then to FIG. 14 there is shown a modified embodiment of stemware according to the present invention. The stemware structure of FIG. 14 is adapted to be made of glass or otherwise adapted to be permanent in its entirety. As here embodied, this stemware structure includes bowl 30 (which may be in any desired configuration) mounted to stem 32 which has a hollow interior portion (indicated at 34). A plurality of holes 36 are formed in stem 32 near its junction with bowl 30 to provide flow communication between the exterior surface of stem 32 and hollow stem chamber 34.

A ring-like collar 38 is formed on stem 32 substantially adjacent holes 36. Advantageously, collar 38 generally encases holes 36 and forms a hollow ring-like trough (indicated at 38*a*) around the portion of the stem wherein holes 36 are formed for collecting any condensation which drips down from bowl 30, as will be explained in greater detail hereinafter. As preferably embodied, collar 38 terminates in an edge spaced only very slightly from the exterior surface of stem 32, leaving only a narrow gap 38*b* therebetween sufficiently wide to permit dripping condensation to pass through the gap and into grough 38*a*.

In use, cold liquid or other substance is placed in bowl 30, as described above. Condensation forming on the exterior surface of bowl 30 will travel down that surface under the influence of gravity and onto the upper portion of stem 32. The travelling condensation then passes through gap 38*b* for collection within ring-like trough 38*a*. The moisture collecting in trough 38*a* then tends to drip harmlessly into hollow stem chamber 34. Advantageously, holes 36 are located at the bottom of the trough to ensure that virtually all the condensation collected therein falls into stem chamber 34.

It will be understood that by terminating the upper edge of collar 38 near the exterior surface of stem 32, moisture in trough 38*a* cannot flow out when a person tips the stemware to drink liquid in bowl 30. Similarly, the portion of stem 32 below collar 38 can be somewhat divergent (like stem 24 described above) to ensure that any moisture in stem chamber 34 will not spill out of holes 36 when the stemware is tipped for drinking. In addition, collar 38 can be formed with a decorative exterior pattern to camoflauge its functional advantages, and, since gap 38*b* is relatively narrow, it will be somewhat difficult to determine that there are functional features incorporated into the stemware. Thus, the condensation-free stemware of the invention can be incorporated in a structure which is as attractive and elegant as most conventional stemware pieces.

Figure 14A:
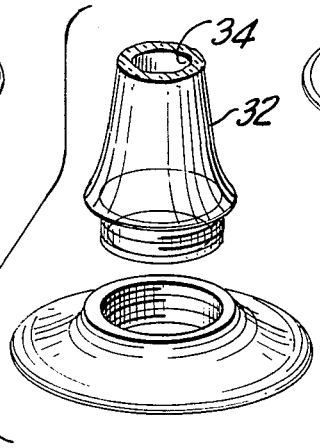
FIG. 14*a* is a partial front isometric view of a modified version of the embodiment illustrated in FIG. 11.

After several uses, the accumulated condensation in chamber 34 can be removed simply by holding the stemware upside-down to permit draining, or by holding it by the stem base and swinging it away from oneself. Alternatively, as illustrated in FIG. 14*a* the bottom of stem 32 at the base of the stemware may be removably attachable to the remainder of the piece, as by threaded interconnection. Thus, the lower portion may simply be removed to permit quick and simple of the accumulated moisture.

Figure 14B:
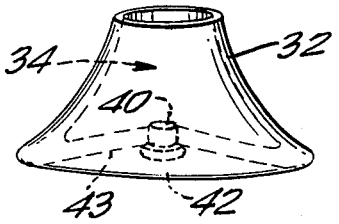
FIG. 14*b* is a partial front isometric view of another modified version of the embodiment of FIG. 14.
Figure 8A:
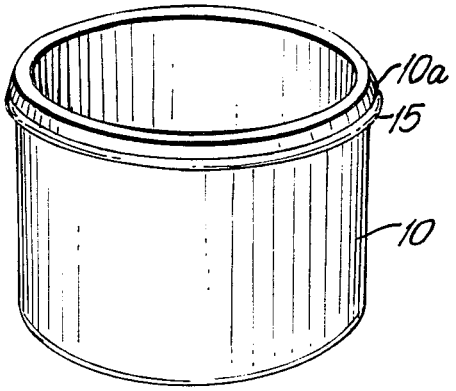
FIG. 8*a* is an isometric view of a preferred embodiment of a permanent vessel, or holder, for the insert member according to the present invention.

As illustrated in FIG. 14*b* the bottom of the stem base may, instead, have a small hole 40 with a removable stopper member 42 to permit drainage of chamber 34. The bottom surface (43) of the stem base may preferably be raised slightly so that stopper 42 does not interfere with the normal standing of the stemware piece.

It will be appreciated by those skilled in the art that the invention in its broader aspects is not limited to the particular embodiments herein shown and described and that variations may be made which are within the scope of the accompanying claims, without departing from the principles of the invention and without sacrificing its chief advantages. For example, ribs, or radially inwardly projecting fins, may additionally be formed at the bottom interior of vessel 10 disclosed in FIGS. 1–5 in combination with ribs 12*b* or 10*b* to enhance the grasping of insert 12. Similarly, the upper end of stem 24 (FIG. 13) may be formed with a collar similar to collar 38 (FIG. 14), and, openings could also be formed in the adjacent wall of stem 24 (instead of ribs 26 and the resultant gaps) to provide flow communication into the interior of stem 24.

It will further be appreciated by those skilled in the art in view of the foregoing description that the lipped insert according to the present invention can be made to conform to the shape of the bowl of a stemware piece so that the stem of the stemware piece need not be hollow as described with reference to FIGS. 13–14.

What is claimed is:

1. A drinking vessel adapted to provide an exterior surface portion substantially free of condensation, comprising:

a first vessel member having an open top and being adapted to receive and contain any desired substance such as a liquid to be consumed;

a second vessel member associated with but generally separated from said first vessel member to form a thermal air space therebetween, said first vessel member comprising a removable insert member proportioned to conform generally to the configuration of said second vessel member, said insert member being receivable within said second vessel member to form a generally double-walled drinking vessel having said thermal air space between said insert member and said second vessel member, said insert member also including a lip along its open top, said lip extending towards the bottom of said insert member and being proportioned to substantially prevent a person's lip from contacting said second vessel member during use, and said insert member being tapered to a greater degree from its open top to its bottom than said second vessel member and further including grasping means associated between said insert member and said second vessel member for permitting releasable engagement between said insert member and said second vessel member, said second vessel member being adapted to provide a barrier against formation of condensation on its exterior holding surface and to form a thermal air space between said insert and second vessel members to provide a thermally insulative gap to help maintain the termperature of any substance contained within said insert member, said second vesel member including vent means for communicating said thermal air space with the ambient surroundings of said drinking vessel to permit thermal expansion and contraction of air within said thermal air space due to the presence of hot or cold substance within said insert member, and said second vessel member further including drip means associated with said vent means for substantially preventing moisture within said thermal air space from spilling through said vent means when said drinking vessel is tilted during use, such that a person can hold said drinking vessel along the exterior holding surface of said second vessel member substantially without contacting any condensation and without any condensation leaking out of said drinking vessel, any condensation forming on said insert member tending to collect within said thermal air space while the exterior surface of said second vessel member remains substantially free of condensation, and, further such that when said second vessel member is thrust down onto a stack of said insert members and thereafter lifted, one said insert member is grasped by said second vessel member yet can be removed therefrom when desired with relative ease for replacement by another said insert member.

2. A two-part drinking vessel having one part adapted to be reused without requiring washing for sanitary reuse and to provide an exterior surface substantially free of condensation, said drinking vessel comprising:

a first vessel member comprising a disposable insert member adapted to contain any desired substance such as a liquid, said insert member having a lip extending downwardly from its open top tim, said lip being proportioned to space a person's lip from said exterior surface when drinking from said drinking vessel, said insert member also including a step-like indentation generally near its bottom to form a reduced diameter portion thereat with an interior shoulder formed at said step-like indentation, said shoulder providing a support surface facing said insert top rim, said reduced diameter portion having an interior diameter, as measured generally at said interior shoulder, at least slightly less than the outer diameter at the insert bottom to permit a plurality of said inserts to be stacked, in inverted orientation, one on top of another, with the shoulder support surface on one insert abutting the next adjacent insert along a portion of its bottom surface to provide nonsticking stackability of insert members in a relatively compact stack of inserts with the shoulder support surface of one insert resting upon the bottom surface of the next insert below it when the inserts are stacked in inverted orientation;

a reusable second vessel member adapted to receive a said insert member, said second vessel member being proportioned to provide a thermal air space between said second vessel member and said insert member when said insert member is seated within said second vessel member, said thermal air space providing insulation for any substance within said insert member to prevent condensation from building up on said exterior surface: and grasping means associated between said insert member and said second vessel member for permitting releasable engagement between said insert member and said second vessel member, such that when said second vessel member is thrust down onto a stack of said insert members and thereafter lifted, one said insert member is releasably grasped by said second vessel member and can be removed from said stack of insert members substantially without sticking to any other insert member in said stack yet it can be removed from said second vessel member when desired with relative ease for replacement by another said insert member by repeating said thrusting motion.

3. A two-part drinking vessel having one part adapted to be reused without requiring washing for sanitary reuse and to provide an exterior surface substantially free of condensation, said drinking vessel comprising:

a first vessel member comprising a disposable insert member adapted to contain any desired substance such as a liquid, said insert member having a lip extending downwardly from its open top rim, said lip being proportioned to space a person's lip from said exterior surface when drinking from said drinking vessel, each said insert member including means permitting a plurality of insert members to be stacked, in inverted orientation, one on top of another, substantially without sticking together;

a reusable second vessel member adapted to receive a said insert member, said second vessel member being proportioned to provide a thermal air space between said second vessel member and said insert member when said insert member is seated within said second vessel member, said thermal air space providing insulation for any substance within said insert member to prevent condensation from building up on said exterior surface; and grasping means associated between said lip of said insert member, along its interior surface, and a generally oppositely disposed surface portion of said second vessel member for permitting releasable engagement between said insert member and said second vessel member, said grasping means comprising a plurality of discrete spaced-apart, generally bead-like protuberances formed on one of said members and a ring-like ridge formed on the other of said members, said protuberances and ring-like ridge being proportioned and positioned relative to each other to releasably secure said insert member within said second vessel member, such that when said second vessel member is thrust down onto a stack of said insert members and thereafter lifted, one said insert member is releasably grasped by said second vessel member by cooperation between said proturberances and said ridge to permit removal from said stack of insert members substantially without sticking to any other insert member in said stack yet it can be removed from said second vessel member when desired with relative ease for replacement by another said insert member by repeating said thrusting motion.

4. A two-part drinking vessel having one part adapted to be reused without requiring washing for sanitary reuse and to provide an exterior surface substantially free of condensation, said drinking vessel comprising:

a first vessel member comprising a disposable insert member adapted to contain any desired substance such as a liquid, said insert member having a lip extending downwardly from its open top rim, said lip being proportioned to space a person's lip from said exterior surface when drinking from said drinking vessel, each said insert member including means permitting a plurality of insert members to be stacked, in inverted orientation, one on top of another, substantially without sticking together;

a reusable second vessel member adapted to receive a said insert member, said second vessel member being proportioned to provide a thermal air space between said second vessel member and said insert member when said insert member is seated within said second vessel member, said thermal air space providing insulation for any substance within said insert member to prevent condensation from building up on said exterior surface, said second vessel member including vent means in its bottom wall for relieving any change in pressure in said thermal air space due to the presence of a hot or cold substance in said insert member and drip means associated with said vent means to substantially prevent any condensation accumulated in said second vessel member from spilling through said vent means when a person tilts said drinking vessel to drink therefrom; and grasping means associated between the inwardly facing surface of said insert member lip and the upper exterior portion of said second vessel member for permitting releasable engagement between said insert member andsaid second vessel member, such that when said second vessel member is thrust down onto a stack of said insert members and thereafter lifted, one said insert member is releasably grasped by said second vessel member and can be removed from said stack of insert members without sticking to any other insert member in said stack yet it can be removed from said second vessel member when desired with relative ease for replacement by another said insert member by repeating said thrusting motion.

5. A drinking vessel according to claim 1, wherein the length of said lip and its angle relative to said second vessel member, along its exterior surface, cooperate to prevent contact of a person's lip with the exterior surface of said second vessel member.

6. A drinking vessel according to claim 1, wherein said grasping means is adapted to provide a releasable friction engagement between said insert member and said second vessel member.

7. A drinking vessel according to claim 6, wherein said grasping means is located generally near the top opening of said insert member.

8. A drinking vessel according to claim 6, wherein said grasping means comprises a plurality of relatively small raised rib-like members.

9. A drinking vessel according to claim 6, wherein said grasping means comprises a band of serrations.

10. A drinking vessel according to claim 8, wherein said rib-like members are formed on and project outwardly from an exterior surface of said insert member.

11. A drinking vessel according to claim 9, wherein said band of serrations is formed on an interior surface protion of said second vessel member generally near its open top.

12. A drinking vessel according to claim 1, wherein said grasping means comprises a plurality of fin-like members formed on said second vessel member generally at the bottom thereof and projecting radially inwardly, said fin-like members being proportioned to releasable grasp said insert member by their radially interior edges.

13. A drinking vessel according to claim 1, wherein said grasping means comprises a plurality of fin-like members formed on said insert member and projecting radially outwardly therefrom, said fin-like members being proportioned to releasably grasp interior surface portions of said second vessel member by their radially outward edges.

14. A drinking vessel according to claim 2, wherein said grasping means comprises a plurality of spaced-apart, generally bead-like protuberances formed on one of said members and engagement means formed on the other of said members, said engagement means being proportioned and positioned to cooperate with said protuberances for releasably locking said members together when said insert member is fully seated within said second vessel member.

15. A drinking vessel according to claim 14, wherein said protuberances are formed on said insert member and said engagement means are formed on said second vessel member.

16. A drinking vessel according to claim 15, wherein said engagement means comprises a ring-like ridge formed on said second vessel member.

17. A drinking vessel according to claim 16, wherein said protuberances are formed on said lip along its interior surface, and wherein said ring-like ridge is formed on said second vessel member on its exterior surface generally near its upper rim edge.

18. A drinking vessel according to claim 17, wherein said protuberances are positioned on said lip so as to bear against said ring-like ridge, generally along its bottom surface portions, for retaining said insert member within said second vessel member when fully seated therein.

19. A drinking vessel according to claim 18, wherein said protuberances and ridge are positioned such that, when said protuberances and ridge are lockably engaged, said protuberances abut said ridge to cause said insert lip to flare outwardly slightly more than when not lockably engaged.

20. A drinking vessel according to claim 15, wherein said engagement means comprises a series of ridge segments formed on said second vessel member, each said ridge segment extending at a relatively small angle relative to the upper rim edge of said second vessel member to permit thereadable engagement between said members.

21. A drinking vessel according to claim 20, wherein said protuberances are formed on said lip along its interior surface, and wherein said ridge segments are formed on said second vessel member on its exterior surface generally near its upper rim edge.

22. A drinking vessel according to claim 21, wherein the number of said protuberances is equal to the number of said ridge segments.

23. A drinking vessel according to claim 15, wherein said engagement means comprises a ring-like recess formed on said second vessel member, said recess being adopted to receive said protuberances releasably lockably retaining said insert member within said second vessel member when fully seated therein.

24. A drinking vessel according to claim 15, wherein said engagement means comprises a series of recess segments formed in said second vessel member, each said recess segment extending at a relatively small angle relative to the upper rim edge of said second vessel member for receiving said protuberances to permit threadable engagement between said members.

25. A drinking vessel according to claim 2, wherein the height of said reduced diameter portion is generally at least about equal to the height of the insert lip to ensure that adjacent inserts do not become wedged together.

26. A drinking vessel according to claim 2, wherein said second vessel member includes vent means therein to relieve any pressure increase or decrease in said spacing between said insert member and said second vessel member and said second vessel member further including drip means associated with said vent means for substantially preventing moisture within said second vessel member from spilling through said vent means when said drinking vessel is tilted during use.

27. A drinking vessel according to claim 26, wherein said drip means of said second vessel member comprises an upwardly extending generally concave bottom which forms a generally convex interior bottom suface in said second vessel member and wherein said vent means comprises an opening in said concave bottom, generally at its apex, such that any moisture collecting within said second vessel member will accumulate along the radially outermost portion of said second vessel bottom away from said opening.

28. A drinking vessel, according to claim 26, wherein said vent means comprises an opening in said second vessel members and wherein said drip means comprises an upwardly extending wall closely surrounding said opening to prevent any condensation accumulated in said second vessel member from exiting through said opening.

29. A drinking vessel according to claim 28, which further includes spacer means for raising the bottom surface of said second vessel member off a support surface.

30. A drinking vessel according to claim 4, wherein said grasping means comprises a plurality of spaced-apart, generally bead-like protuberances formed on one of said members and engagement means formed on the other of said members, said engagement means being proportioned and positioned to cooperate with said protuberances for releasably locking said members together when said insert member is fully seated within said second vessel member.

31. A drinking vessel according to claim 30, wherein said protuberances are formed on said insert member and said engagement means are formed on said second vessel member.

32. A drinking vessel according to claim 31, wherein said engagement means comprises a ring-like ridge formed on said second vessel member.

33. A drinking vessel according to claim 32, wherein said protuberances are formed on said lip along its interior surface, and wherein said ring-like ridge is formed on said second vessel member on its exterior surface generally near its upper rim edge.

34. A drinking vessel according to claim 33, wherein said protuberances are positioned on said lip so as to bear against said ring-like ridge, generally along its bottom surface portions, for retaining said insert member within said second vessel member when fully seated therein.

35. A drinking vessel according to claim 34, wherein said protuberances and ridge are positioned such that, when said protuberances and ridge are lockably engaged, said protuberances abut said ridge to cause said insert lip to flare outwardly slightly more than when not lockably engaged.

36. A disposable insert for use with a drinking vessel, comprising an insert member having an open top to receive liquid or other substance and being proportioned to conform generally to the configuration of a permanent container so as to be receivable within the permanent container and form a generally double-walled drinking vessel having a thermal spacing between said insert member and the permanent container for the collection of condensation forming on said insert member to provide an interior surface of the permanent container substantially free of condensation, said insert member including a lip at its top edge extending toward its bottom, said lip being proportioned to substantially prevent a person's lip from contacting the permanent container yet permit a plurality of said insert members to be stacked on top of each other, said insert also including a step-like indentation generally near its bottom to form a reduced diameter portion at the bottom of said insert, with an interior shoulder formed at said step-like indentation, said shoulder providing a support surface facing said insert top edge, said reduced diameter portion having an interior diameter, as measured generally at said interior shoulder, at least slightly less than the outer diameter at the insert bottom, to permit a plurality of said inserts to be stacked, in inverted orientation, one on top of another, with the shoulder support surface of one insert abutting the next adjacent insert along a portion of its bottom surface for substantial non-sticking stackability of inserts in a relatively compact stack of inserts with the shoulder support surface of one insert resting upon the bottom surface of the next insert below it when the inserts are stacked in inverted orientation such that when a permanent container is thrust down onto a stack of said inserts and thereafter lifted, one said insert is releasably grasped by the container and can be removed from said stack of inserts substantially without sticking to any other inserts in said stack yet it can be removed from the container when desired with relative ease for replacement by another insert by repeating said thrusting motion.

37. An insert member according to claim 36, wherein the width of said lip and its angle relative to the exterior surface of said permanent container cooperate to prevent contact of a person's lip with the exterior surface of said permanent container.

38. An insert member according to claim 36, wherein said insert member is tapered to a greater degree from its open top to its bottom than said permanent container and which further includes grasping means for permitting releasable engagement between said insert member and said permanent container, such that when said permanent container is thrust down onto a stack of inverted insert members and thereafter lifted, one said insert member is grasped by said permanent container yet can be removed from said permanent container when desired.

39. An insert member according to claim 38, wherein said grasping means is located generally near the top opening of said insert member.

40. An insert member according to claim 39, wherein said grasping means comprises a plurality of relatively small raised rib-like members.

41. An insert member according to claim 40, wherein said rib-like members are formed and project outwardly from exterior surface of said insert member.

42. An insert member according to claim 36, wherein said insert member includes a plurality of protuberances formed thereon, said protuberances being adapted to cooperate with engagement means formed on the permanent container for releasably locking said insert to the permanent container and for permitting a plurality of said inserts to be stacked on top of each other while enabling only one insert to be removed when the permanent container is thrust down onto a stack of inverted insert members.

43. An insert member according to claim 42, wherein said protuberances are formed on said lip, generally along its interior-facing surface.

44. An insert member according to claim 43, wherein said protuberances are proportioned to engage said engagement means such that said lip is caused to flare slightly more when said insert is fully seated in the permanent container than when not seated therein.

45. An insert member according to claim 42, wherein said lip extends at an angle of between about 4.5° and about 5° relative to the vertical when said insert is standing on a horizontal surface.

46. An insert according to claim 45, wherein the height of said reduced diameter portion is generally at least about equal to the height of the insert lip to ensure that adjacent inserts do not become wedged together.

47. An insert according to claim 36, which further includes grasping means for permitting releasable engagement between said insert member and said permanent container, such that when said permanent container is thrust down onto a stack of inverted insert members and thereafter lifted, one said insert member is grasped by said permanent container yet can be removed from said permanent container when desired.

48. An insert according to claim 47, wherein said grasping means comprises a plurality of protuberances formed thereon, said protuberances being adapted to cooperate with engagement means formed on the permanent container for releasably locking said insert to the permanent container and for permitting a plurality of said inserts to be stacked on top of each other while enabling only one said insert to be removed when the permanent container is thrust down onto a stack of inverted insert members.

49. An insert according to claim 48, wherein said protuberances are formed on said lip, generally along its interior-facing surface.

50. An insert according to claim 49, wherein said protuberances are proportioned to engage said engagement means such that said lip is caused to flare slightly more when said insert is fully seated in the permanent container than when not seated therein.

* * * * *